United States Patent [19]

Böcker et al.

[11] Patent Number: 4,559,876

[45] Date of Patent: Dec. 24, 1985

[54] PENETRATOR PROJECTILES

[75] Inventors: Jürgen Böcker, Oberhausen; Klaus W. Klein, Neuss; Klaus Gersbach, Willich, all of Fed. Rep. of Germany

[73] Assignee: Rheinmetall GmbH, Duesseldorf, Fed. Rep. of Germany

[21] Appl. No.: 603,132

[22] Filed: Apr. 23, 1984

[30] Foreign Application Priority Data

Apr. 23, 1983 [DE] Fed. Rep. of Germany ..... 3314752

[51] Int. Cl.[4] ..... F42B 13/16

[52] U.S. Cl. ..... 102/520; 102/501; 102/517; 102/703

[58] Field of Search ..... 102/501, 517–523, 102/703, 247–453

[56] References Cited

U.S. PATENT DOCUMENTS

| | | | |
|---|---|---|---|
| 3,620,167 | 11/1971 | Romer et al. | 102/521 |
| 3,672,304 | 6/1972 | Rogers et al. | 102/501 |
| 4,284,008 | 8/1981 | Kirkendall et al. | 102/521 |
| 4,389,937 | 6/1983 | Bolay et al. | 102/249 |

*Primary Examiner*—Harold J. Tudor

[57] ABSTRACT

A nose unit for a discarding sabot penetrator having a bolt in a bore of the pointed nose which is temporarily displaced on firing due to acceleration and against a restoring spring. This produces a circular edge and a break in the contour of the nose to define a limit surface between a zone or supersonic airflow and a zone of subsonic airflow, at least during the separation of the sabot segments. This facilitates the uniformed detachment of the segments.

2 Claims, 4 Drawing Figures

PENETRATOR PROJECTILES

BACKGROUND OF THE INVENTION

This invention relates to a pointed nose unit for a penetrator projectile.

In penetrator projectiles with discarding sabots, such as are described in U.S. Pat. No. 3,899,978, the sabot is provided with an air dam which surrounds it in the vicinity of the front of the penetrator and serves to initiate detachment of the sabot segments through incident air flow after it has left the barrel of a weapon. The detachment of the sabot segments from the penetrator body during firing has been found to frequently take place unevenly. This can impart oscillations to the projectile. The oscillations may reduce not only the aiming accuracy but also the penetrative power which is particularly relevant when used against modern targets which require penetrators of considerable length which must be substantially free of any tendency to oscillate.

Experiments carried out on the behavior of penetrators and sabot systems have shown that in the zone around the front part of the projectile unstable air flow conditions may occur which prevent the sabot from separating evenly.

An object of this invention is to provide a pointed nose unit for a penetrator projectile.

According to the present invention a penetrator projectile is provided with a pointed nose having a high ratio of length to diameter and constructed to be at least transitionally variable in shape to improve the separation of discardable sabot segments after emerging from the barrel of a weapon.

BRIEF DESCRIPTION OF THE DRAWINGS

The invention is further described in more detail with reference to the two preferred embodiments shown in the accompanying drawings. In the drawings the nose end of a penetrator is shown in longitudinal section.

DETAILED DESCRIPTION OF THE DRAWINGS

Figure 1:
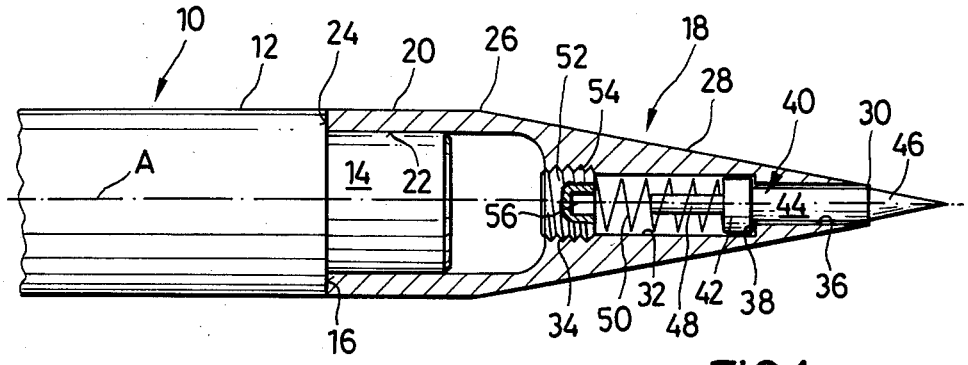
FIG. 1 is a first embodiment in the initial position.

Referring to the drawings, FIG. 1 shows a penetrator projectile 10 with a peripheral surface 12 and a front stud 14 extending beyond an annular shoulder 16. The stud 14 serves to secure a pointed nose body 18 which has a rear cylindrical portion with an outer peripheral surface 20, an inner peripheral surface 22 and a rear circular annular face 24 which bears against the annular shoulder 16. The outer peripheral surface 20 extends as far as an edge 26 which forms a juncture with a conical surface 28 extending to a front edge 30. The part of the pointed nose body 18 which is associated with the conical surface 28 has coaxial bores 32, 34, and 36 of different diameters. An annular shoulder 38 delimits the front end of coaxial bore 32 which has a greater diameter than coaxial bore 36. A bolt 40 has a piston 42 fitted to the bore 32 and a front part 44 with a conical point 46 fitted to the bore 36. This assembly is mounted in the pointed body 18 in such a way as to axially movable. A stub 48 extending toward the rear beyond the piston 42 is embraced by a coil compression spring 50. A rear abutment 52 for the spring is secured by a screw threading 54 in the bore 34 and has a blind hole 56 for the free end of stub 48.

Figure 2:
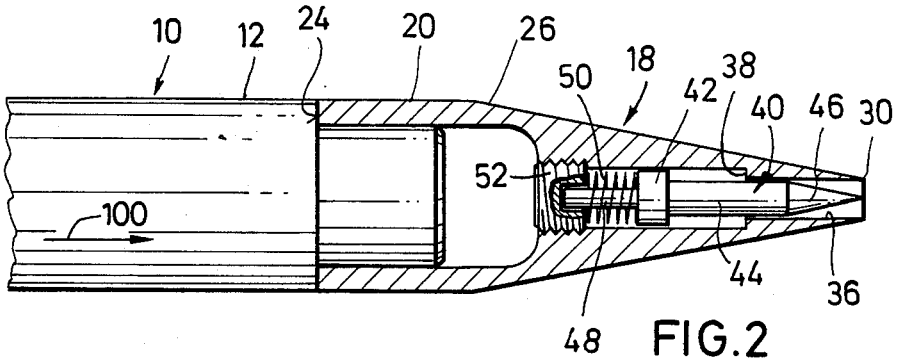
FIG. 2 shows the embodiment of FIG. 1 in a position after the firing acceleration phase.
Figure 3:
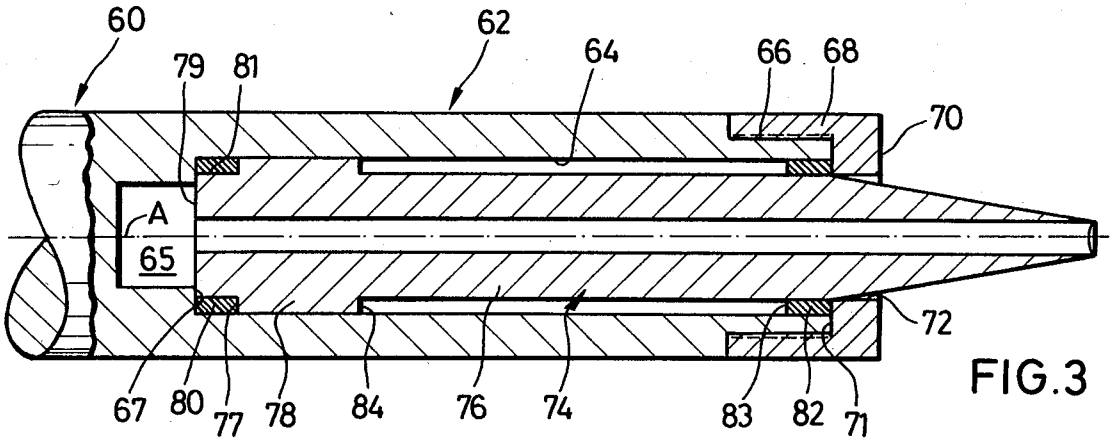
FIG. 3 is a second embodiment in the initial position.

FIG. 1 shows the pointed body in the initial position. When the penetrator 10 is fired and accelerated in the direction 100, as shown in FIG. 2, bolt 40, owing to its mass, assumes the position shown in FIG. 2. The conical point 46 retracts into the bore 36. When the projectile 10 emerges from the barrel of a weapon a limit zone between a zone with a supersonic flow and a zone with a subsonic flow is formed at the edge 30. This facilitates the even separation of sabot segments (not shown). For this purpose a $c_w$ coefficient (drag coefficient) greater than that occurring in the initial position is temporarily accepted. Azfer the firing acceleration has reduced, bolt 40 moves forward and the point 46 is restored to the forward projecting position by the force of spring 50. The $c_w$ coefficient (drag coefficient) is thereby reduced to the value associated with the initial position. (For a definition of $c_w$ see Rheinmetall *Handbook of Weaponry*, pp. 144–147, Broenners Druckerei Breidenstein GmbH, frankfurt a.M., Second English Edition 1982.) In FIG. 3 a penetrator 60 has a cylindrical body 62 with an axial bore 64 which, at an annular face 67, reduces to a blind hole 65 of smaller diameter. At the front of penetrator 60, a shoulder 66 is provided with a screw threading. The screw threading secures a bushing 68 with an outer annular end face 70, a corresponding inner face 71, and a central bore 72. The axial bore 64 accommodates an insert 74 with a shouldered front part 76 and a piston 78. The piston 78 is adapted to the bore 64 and has a rear face 77. A packing 80 embraces a shoulder 81 and extends from rear face 77 to an end face 79. In the vicinity of the corresponding inner face 71 is a packing 82 which embraces the shouldered front part 76. This latter part extends as a cylinder to a front edge 86 and then continues in the form of a conical nose 88. The insert 74 has an axial through bore 90 with a front end 94 defining an annular edge 92. The rear end 96 of insert 74, in the initial state, terminates in blind hole 65.

Figure 4:
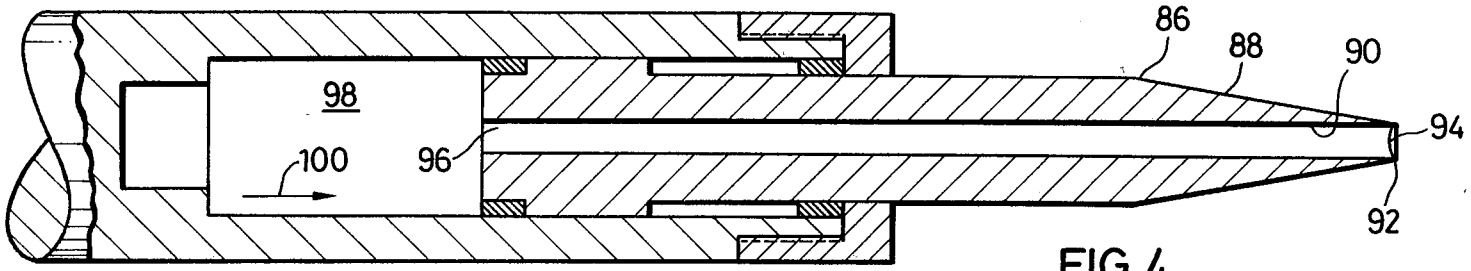
FIG. 4 shows the embodiment of FIG. 3 in an intermediate position during flight.

In the initial state the insert 74 takes up a position as shown in FIG. 3. On the emergence of the penetrator 60 from the barrel of a weapon (not shown) the front annular face 70 forms a step in the contour and provides a limiting surface between a supersonic airflow and a subsonic zone. This assists the uniform separation of sabot segments (not shown) from the penetrator 60 and, for this purpose, a less favorable $c_w$ coefficient has to be expected. During the flight of the projectile air flows through the bore 90 and causes an accumulation of pressure behind the rear end face 79. As a result of this the insert is moved in the direction 100 (FIG. 4) to provide improved $c_w$ coefficient in comparison with that shown in FIG. 3. FIG. 4 shows the insert 74 in an intermediate position. A terminal position will be reached when the face 84 of the piston 78 bears against face 83 of the packing 82.

The subcaliber projectiles described herein have a length to diameter ratio ranging from 10/1 to 30/1.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. An improved penetrator projectile having high length to diameter ratio and being encompassed by a segmented sabot which separates from the projectile as soon as it exits from the muzzle of a gun barrel, the projectile comprising in combination, a projectile body having a forwardly extending cylindrical portion;

a frusto-conically shaped nose portion having a rearwardly extending cylindrical portion which defines a first bore, said forwardly extending portion matingly extending into the first bore of said rearwardly extending cylindrical portion so that said nose portion and projectile body are coaxially mounted relative to each other;

said nose portion having an axial second bore extending therethrough; said second bore having a front end which defines an annular forward edge in said frusto-conically shaped nose portion and also including front and rear stop means;

a pin having a pointed front end being axially movably mounted in said bore between front and rear stop means;

biasing means being operatively mounted in said second bore for biasing said pin forwardly against said front stop means; said pointed front end of said pin forming a continuous cone with said frusto-conically shaped nose portion when said pin abuts against said front stop means and said pointed front end being fully retracted into said second bore when said pin abuts against said rear stop means.

2. The improved penetrator projectile as set forth in claim 1, wherein said rear stop means include a stop member having an axial blind bore, said stop member is axially threadably mounted in said second bore, said pin having a collar and a cylindrical rearwardly extending pin portion which is adapted to matingly extend into said blind bore when said pin abuts against said rear stop means, said biasing means including a coil spring which is coaxially mounted about said rearwardly extending pin portion and which abuts with one of its ends against said stop member and with the other end against said collar.

* * * * *